United States Patent [19]

Sutherland

[11] Patent Number: 4,671,506

[45] Date of Patent: Jun. 9, 1987

[54] PORTABLE PLAYGROUND CARROUSEL

[76] Inventor: Donald Sutherland, 7827 Flintridge, Houston, Tex. 77028

[21] Appl. No.: 738,121

[22] Filed: May 24, 1985

Related U.S. Application Data

[63] Continuation-in-part of Ser. No. 512,346, Jul. 11, 1983, Pat. No. 4,519,602.

[51] Int. Cl.[4] ..... A63G 1/12

[52] U.S. Cl. ..... 272/33 R

[58] Field of Search ..... 272/33 R, 33 A, 51, 272/28 R, 30

[56] References Cited

U.S. PATENT DOCUMENTS

| | | | |
|---|---|---|---|
| 1,791,227 | 2/1931 | Russell | 272/33 R |
| 1,877,256 | 9/1932 | Siebert . | |
| 1,881,863 | 10/1932 | Nairn | 272/30 |
| 2,467,338 | 4/1949 | Sellards | 272/33 R |
| 2,547,152 | 4/1951 | Burg | 272/51 |
| 2,995,369 | 8/1961 | Amble | 272/51 |
| 3,661,386 | 5/1972 | Green | 272/33 R |
| 4,519,602 | 5/1985 | Sutherland | 272/33 R |

FOREIGN PATENT DOCUMENTS

| | | | |
|---|---|---|---|
| 365311 | 9/1906 | France | 272/51 |
| 914258 | 6/1946 | France | 272/33 R |
| 2421474 | 11/1975 | France | 272/33 R |
| 199236 | 6/1923 | United Kingdom | 272/30 |

*Primary Examiner*—Robert A. Hafer
*Assistant Examiner*—Arnold W. Kramer
*Attorney, Agent, or Firm*—Neal J. Mosely

[57] ABSTRACT

An amusement device comprises a portable rotary carrousel which is occupant propelled. More particularly, the device comprises a housing anchored angularly on a base and an axle extending upwardly therefrom to accept and support an inclined carrousel. Individuals seated at opposite ends of the carrousel cause the axle to rotate by shifting their weight. Alternatively, the device may include a conventional automobile rear end differential to transmit rotary motion for operation of an external structure. The differential is anchored angularly on the base which has the housing and axle extending upwardly therefrom to accept and support the inclined carrousel. The differential may be operatively connected by a drive shaft, transmission, and universal joint to transmit rotary motion produced by the inclined carrousel for operation of the external structure.

4 Claims, 3 Drawing Figures

PORTABLE PLAYGROUND CARROUSEL

CROSS REFERENCE TO RELATED APPLICATIONS

This application is a continuation-in-part of applicant's co-pending application Ser. No. 512,346, filed July 11, 1983, and now U.S. Pat. No. 4,519,602.

FIELD OF THE INVENTION

This invention relates to occupant propelled carrousels and more particularly to an amusement device comprising a portable rotary carrousel which is occupant propelled.

BRIEF DESCRIPTION OF THE PRIOR ART

Occupant propelled amusement devices and carrousels are known in the art. There are several patents which illustrate the state of the art of carrousels and amusement devices.

Willard, U.S. Pat. No. 3,439,914 discloses an inclined carrousel propelled by weight shifting of the occupants to change the center of gravity. The device comprises a body member rotatable in an oblique plane and carrying free turning seats at each end. To operate the carrousel, the seated occupant imparts a rotational force to cause the carrousel to rotate about its inclined or oblique axis. The carrousel is self contained and is not used as a driving or propelling means for other devices.

Eckberg, U.S. Pat. No. 1,670,882 discloses an amusement device for supporting people and allowing them to revolve around a stationary support. To operate the device, a person seated in the highest position leans back causing an increase in weight at the highest point of the wheel. A person on the lowest part of the wheel leans forward, causing a decrease in weight at the lowest point of the wheel. This device is also self contained and not used as a driving or propelling means for other devices.

Pricer, U.S. Pat. No. 2,497,372 discloses a combination swing and merry-go-round which is occupant propelled. The oscillating motion of the swing is converted into a rotary motion for transmission to the merry-go-round by means of a pawl and ratchet clutch mechanism mounted on the oscillating shaft and which drives a set of bevel gears to rotate the merry-go-round.

The prior art in general, and these patents in particular, do not disclose this invention which comprises a portable inclined occupant-propelled carrousel and which may alternatively include a conventional automobile rear end differential adapted to provide rotary motion to an external structure. Rotary motion is transferred from the carrousel to the external structure through the differential and operatively connected by a drive shaft, universal joint, and transmission.

SUMMARY OF THE INVENTION

It is therefore one object of the invention to provide a portable rotary on carrousel which is easily transported from one location to another.

Another object of this invention is to provide a portable carrousel whereby the carrousel is rotated by the occupants thereof shifting their weights.

Another object of this invention is to provide a portable carrousel capable of being connected to an external structure whereby the carrousel will be rotated by the occupants thereof for transmitting rotary motion to the external structure.

Another object of this invention is to provide a novel connecting means whereby the rotary motion of the carrousel is transmitted to the external structure.

Another object of the invention is to provide a means whereby the ratio of the produced rotary motion of the carrousel may be selectively altered.

Another object of the invention is to provide an amusement device inexpensively manufactured from discarded materials.

Other objects of the invention will become apparent from time to time throughout the specification and claims as hereinafter related.

The above noted objects and other objects of the invention are accomplished by the present invention comprising a portable inclined occupant-propelled carrousel easily carried from one location to another and which may alternatively include a conventional automobile rear end differential adapted to provide rotary motion to an external structure. Rotary motion is transferred from the carrousel to the external structure through the differential and operatively connected by a drive shaft, universal joint, and transmission.

DESCRIPTION OF THE PREFERRED EMBODIMENT

Figure 1:
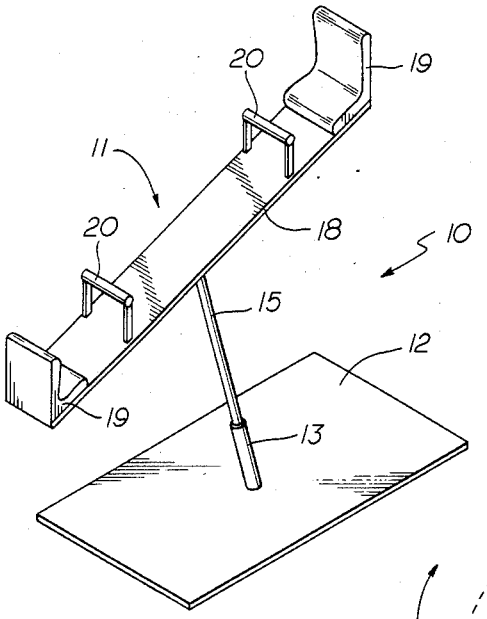
FIG. 1 is an isometric view of a preferred portable occupant-propelled carrousel in accordance with the present invention.
Figure 2:
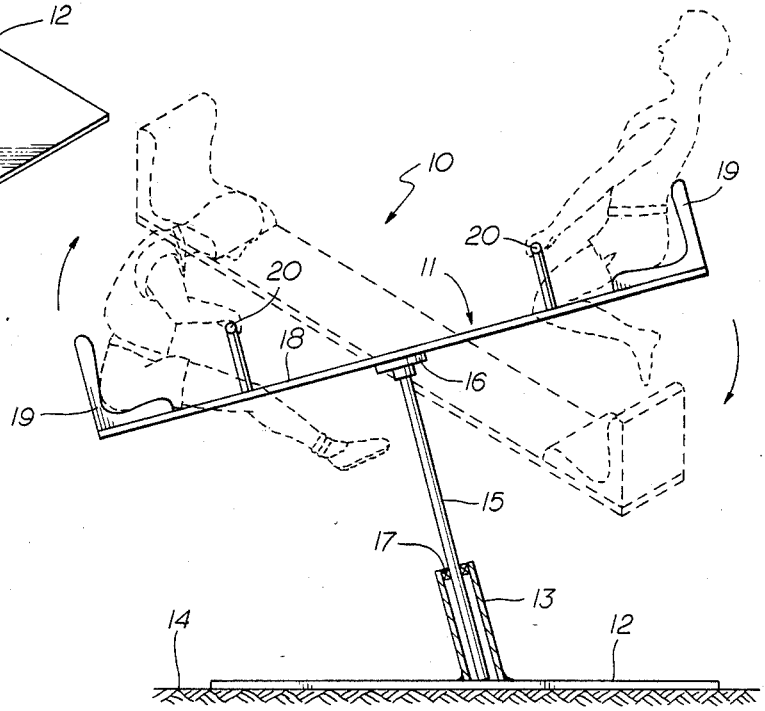
FIG. 2 is a view in elevation of the portable carrousel of FIG. 1 with portions shown in cross section and the propelling and rotational motion illustrated schematically.

Referring to the drawings by numerals of reference, and particularly to FIGS. 1 and 2, there is shown a preferred portable amusement device 10 including an inclined rotary carrousel 11. A flat rectangular baseplate 12 has a hollow tubular axle housing 13 secured centrally thereto to extend upwardly therefrom at an angle. The baseplate 12 is supported on the surface of the ground 14 to form a support structure for the carrousel 11. An axle 15 extends upwardly inside the housing 13. A flange 16 is affixed to the extended end of the axle 15. A bearing 17 is located between the axle 15 and the inside of the axle housing 13 near its extended end to centralize the axle therein and provide smooth rotary motion therebetween. An elongated flat rectangular crossmember 18 is bolted at its center to the flange 16. Each end of the crossmember 18 is provided with a seat 19 and handle 20.

Figure 3:
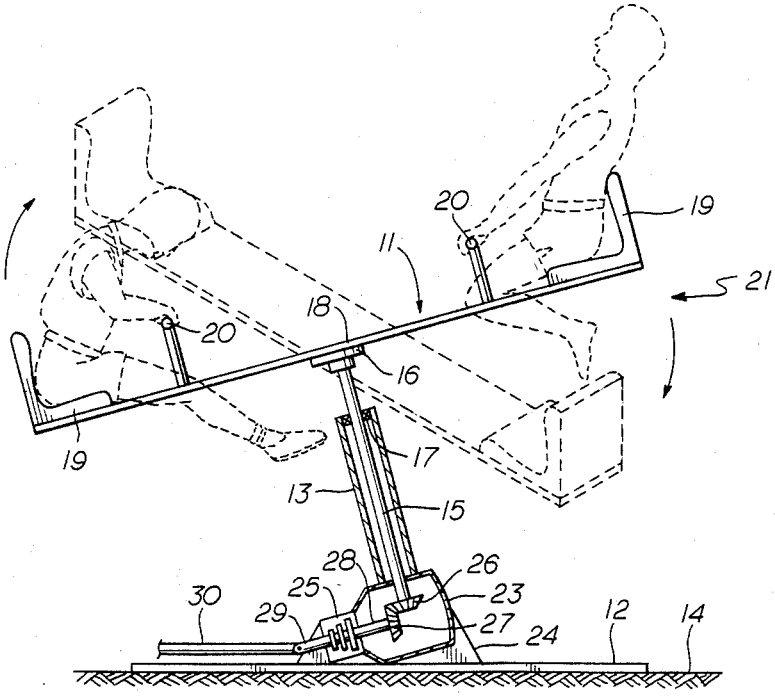
FIG. 3 is a view in elevation of a modification of the portable carrousel including rotary motion transmitting means with portions shown in cross section and the propelling and rotational motion illustrated schematically.

Referring now to FIG. 3, there is shown a modified portable amusement device 21 including an inclined rotary carrousel 11 and a conventional automobile rear end differential 23. It should be noted that certain parts used in construction of the device are conventional and are shown in simple schematic form for ease of understanding by those skilled in the art, and identical parts previously described are given the same numerals of reference to avoid repetition. The differential 23 is secured centrally and angularly onto a flat rectangular baseplate 12 by welding and bracing with appropriate gussets 24 and has a hollow tubular axle housing 13 which extends upwardly therefrom at an inclined angle relative to the baseplate. The baseplate 12 including the differential 23, and axle housing 13 is supported on the surface of the ground 14 to form a support structure for the carrousel 11.

A conventional automobile manual transmission 25 is bolted to one side of the differential 23 to provide a gear reduction means. The differential 23 contains a differential side gear 26 and drive pinion gear 27. An axle 15 extends upwardly inside the housing 13 from the side gear 26. A flange 16 is affixed to the extended end of the axle 15. A bearing 17 is located between the axle 15 and the inside of the axle housing 13 near its extended end to centralize the axle therein and provide smooth rotary motion therebetween. An elongated flat rectangular crossmember 18 is bolted at its center to the flange 16. Each end of the crossmember 18 is provided with a seat 19 and handle 20.

The main shaft 28 of the conventional transmission 25 has one end connected to the the drive shaft having drive pinion 27 thereon inside the differential 23 and its other end is provided with a universal joint 29. An elongated drive shaft 30 may be attached at one end to the universal joint 29 to extend horizontally therefrom. The drive shaft 30 may have its other end operatively connected to an external structure (not shown). The external structure would obviously be provided with means for receiving the other end of the drive shaft and converting the rotary motion transmitted thereby to operate various mechanisms such as other amusement devices.

Those skilled in the art will easily understand that the unused portions of the differentials and transmission may be eliminated.

One example of an external device is disclosed in applicant's co-pending application Ser. No. 512,346, filed July 11, 1983. The structure disclosed therein is provided with a second conventional automobile rear end differential having one axle housing embedded in concrete below the surface of the ground and a second axle housing extending vertically from the differential which contains a conventional axle, axle bearing, and flange to form a support structure for a rotatable tub. The tub is a hollow cylindrical member secured to the top of axle and provided with seats. The differential is operatively connected to the drive shaft, to rotate the tub as the occupants propell the carrousel.

OPERATION

Referring again to FIGS. 2 and 3, the principle of the operation can be seen. Individuals are seated in the seats 19 on opposite ends of the inclined crossmember 18 and hold onto the handles 20. When the person seated on the lower end of the crossmember 18 leans forward, the weight at the upper end will cause the crossmember 18 to rotate, indicated by arrows. As the person originally at the upper end reaches the lower end, the other person raises up to provide the added weight and the person at the lower end leans forward to shift the center of gravity and keep the crossmember 18 turning. The crossmember will continue to rotate as the persons shift their weight.

As showm in FIG. 3, the rotary motion thus created by the carrousel 11 may be transmitted through the inclined axle 15 and to the differential side gear 26. The side gear 26 cooperates with the drive pinion gear 27 to transfer the rotary motion to the mainshaft 28 of the transmission 25. The appropriate transmission gear is pre-engaged to provide the desired gear reduction ratio. From the transmission 25, the rotary motion is transmitted to the universal joint 29 and through the drive shaft 30 to an appropriate external structure.

If first gear is selected at the transmission, the carrousel will rotate two and one-half times as fast as the drive shaft and will provide more torque to drive the exernal device. If second gear is selected, the ratio would be somewhat less than two to one, and the drive shaft would rotate faster. If third gear is selected, the carrousel and the drive shaft would rotate at the same speed.

While this invention has been described fully and completely with special emphasis upon several preferred embodiments, it should be understood that within the scope of the appended claims the invention may be practiced otherwise than is specifically described herein.

I claim:

1. A portable amusement carrousel apparatus, comprising a portable carrousel supporting structure having a base supported on the surface of the ground and an automobile differential secured at an angle thereon and having an axle housing extending angularly upward relative to the ground, and an axle extending from the differential up through the axle housing for supporting a carousel in an inclined position for rotation about the axis of said axle, an occupant actuated and occupant supporting carrousel supported by said axle for rotary movement therewith, said differential comprising a first gear means mounted therein and connecting to said axle, and second gear means mounted in said differential engaging said first gear means, said occupant actuated and occupant supporting carrousel comprising an elongated cross member supported at its midpoint and having seats and handles at opposite ends thereof, whereby occupants of said seats can effect rotation of said carrousel by shifting their respective weights forward and backward or from side to side.

2. A portable amusement carrousel apparatus according to claim 1 further comprising a drive shaft extending horizontally from said differential and operatively connected to said second gear means, whereby, rotation of said carrousel by the occupants thereof shifting their weights is effective to transmit rotary motion to rotate said drive shaft.

3. A portable amusement carrousel apparatus according to claim 1 wherein the operative connection of said drive shaft to said second gear means is by gear reduction means operatively connected to said second gear means and to said drive shaft for selectively changing the ratio of rotation therebetween.

4. A portable amusement carrousel apparatus according to claim 3 wherein said gear reduction means is a manual automobile transmission.

* * * * *